US008506287B2

(12) United States Patent
Perry et al.

(10) Patent No.: US 8,506,287 B2
(45) **Date of Patent: *Aug. 13, 2013**

(54) INDUSTRIAL BURNER

(75) Inventors: Douglas M. Perry, Muncie, IN (US); Jeffrey T. Rafter, Gaston, IN (US)

(73) Assignee: Honeywell International Inc., Morristown, NJ (US)

( * ) Notice: Subject to any disclaimer, the term of this patent is extended or adjusted under 35 U.S.C. 154(b) by 445 days.

This patent is subject to a terminal disclaimer.

(21) Appl. No.: 12/752,532

(22) Filed: Apr. 1, 2010

(65) Prior Publication Data

US 2010/0190119 A1 Jul. 29, 2010

Related U.S. Application Data

(63) Continuation of application No. 11/680,460, filed on Feb. 28, 2007.

(60) Provisional application No. 60/743,388, filed on Mar. 1, 2006.

(51) Int. Cl.
*F23C 7/00* (2006.01)

(52) U.S. Cl.
USPC ..... 431/9; 431/159; 431/181; 431/182; 110/260; 110/262; 110/268; 60/733; 60/776

(58) Field of Classification Search
USPC ..... 431/159, 181, 182, 183, 353, 351, 431/173, 177, 116, 166, 266; 110/260, 262, 110/268, 204, 264; 432/159; 60/733, 776, 60/740, 39.23
See application file for complete search history.

(56) References Cited

U.S. PATENT DOCUMENTS

| | | | | |
|---|---|---|---|---|
| 2,276,131 | A * | 3/1942 | Wiant | 239/116 |
| 4,464,108 | A * | 8/1984 | Korenyi | 431/265 |
| 4,515,094 | A | 5/1985 | Azuhata et al. | |
| 4,598,553 | A * | 7/1986 | Saito et al. | 60/733 |
| 4,919,611 | A | 4/1990 | Flament | |
| 5,144,804 | A * | 9/1992 | Koblish et al. | 60/740 |
| 5,236,350 | A | 8/1993 | Cummings, III et al. | |
| 5,460,514 | A | 10/1995 | Toyoshima et al. | |
| 5,516,280 | A | 5/1996 | Kostiuk et al. | |
| 5,573,391 | A | 11/1996 | Benson et al. | |
| 5,636,510 | A * | 6/1997 | Beer et al. | 60/39.23 |
| 5,735,681 | A | 4/1998 | Cheng | |
| 5,807,094 | A | 9/1998 | Sarv | |
| 5,823,764 | A | 10/1998 | Alberti et al. | |
| 5,879,148 | A | 3/1999 | Cheng et al. | |
| 5,993,193 | A | 11/1999 | Loftus et al. | |
| 6,059,566 | A | 5/2000 | Cummings, III | |

(Continued)

FOREIGN PATENT DOCUMENTS

| | | | |
|---|---|---|---|
| EP | 1 106 928 | A1 | 6/2001 |
| WO | 9851966 | A1 | 11/1998 |

OTHER PUBLICATIONS

Supplementary European Search Report and European Search Opinion for Application EP 07 75 7703. Date: Dec. 1, 2010 Number of pp. 7.

*Primary Examiner* — Avinash Savani
(74) *Attorney, Agent, or Firm* — Barnes & Thornburg LLP

(57) ABSTRACT

An apparatus and process is provided for combining fuel and combustion air to produce a mixture. The mixture is burned in a combustion chamber to produce a flame.

19 Claims, 7 Drawing Sheets

(56) References Cited

U.S. PATENT DOCUMENTS

| | | | | |
|---|---|---|---|---|
| 6,238,206 | B1 | 5/2001 | Cummings, III et al. | |
| 6,315,551 | B1 | 11/2001 | Salzsieder et al. | |
| 6,453,673 | B1 * | 9/2002 | Bechtel et al. | 60/776 |
| 6,524,098 | B1 | 2/2003 | Tsirulnikov et al. | |
| 6,832,481 | B2 * | 12/2004 | Koenig et al. | 60/737 |
| 6,843,185 | B1 | 1/2005 | Taylor | |
| 6,951,454 | B2 | 10/2005 | Sarv et al. | |
| 6,993,916 | B2 * | 2/2006 | Johnson et al. | 60/776 |
| 7,213,522 | B2 * | 5/2007 | Okazaki et al. | 110/347 |
| 7,316,117 | B2 * | 1/2008 | Ohri | 60/796 |
| 2001/0046649 | A1 | 11/2001 | Schutz et al. | |
| 2003/0222235 | A1 | 12/2003 | Filkovski et al. | |
| 2004/0144094 | A1 | 7/2004 | Moriya et al. | |

* cited by examiner

INDUSTRIAL BURNER

CROSS-REFERENCE TO RELATED APPLICATIONS

This application is a continuation of U.S. patent application Ser. No. 11/680,460 filed Feb. 28, 2007, which claims the benefit of priority under 35 U.S.C. §119 (e) to U.S. Provisional Patent Application Ser. No. 60/743,388, filed Mar. 1, 2006, the contents of both applications of which are incorporated herein by reference in their entirety.

BACKGROUND

The present disclosure relates to burner assemblies, and particularly to a low-emission industrial burner. More particularly, the present disclosure relates to a burner and process for burning a combustible air/fuel mixture to produce a flame.

SUMMARY

According to the present disclosure, an apparatus and process is provided for combining fuel and combustion air to produce a mixture to be burned in a combustion chamber. The mixture is a combination of a swirling air/fuel mixture and a non-swirling air/fuel mixture.

The apparatus is configured to mix a first fuel stream with a laminar flow of air passing through a first airflow channel to produce a straight-line air/fuel mixture. The apparatus is also configured to mix a second fuel stream with a swirling flow of air passing through a second airflow channel to produce a swirling air/fuel mixture. An ignitor is configured and arranged to ignite a combustible mixture comprising the straight-line and swirling air/fuel mixtures in a combustion chamber to produce a stable flame.

In an illustrative embodiment, a fluid-injector tube is coupled to a fluid supply and arranged to inject an auxiliary fluid stream into the combustion chamber to combine with the straight-line and swirling air/fuel mixtures to produce the combustible mixture. In illustrative embodiments, the auxiliary fluid stream comprises a fuel gas, a liquid fuel, oxidants, or inerts. It is within the scope of the present disclosure to omit this auxiliary fluid stream.

The process comprises the steps of discharging a first fuel stream into a stream of air flowing in a first airflow channel to produce a non-swirling straight-line air/fuel mixture and discharging a second fuel stream into a stream of air flowing in a second airflow channel to produce a swirling air/fuel mixture. The process further comprises the step of flowing the swirling air/fuel mixture alongside the non-swirling air/fuel mixture in an air/fuel transfer channel in a direction toward a combustion chamber to generate an air-and-fuel mixture flowing in the air/fuel transfer channel.

In illustrative embodiments, the process further includes the steps of using the air/fuel transfer channel to transfer mixtures discharged from the first and second airflow channels into a downstream combustion chamber and passing an auxiliary fluid stream through a fluid-injector tube extending through the first airflow channel to combine the auxiliary fluid stream with the swirling and non-swirling air/fuel mixtures to produce a combustible mixture in the combustion chamber The auxiliary fluid stream comprises one or more of a fuel gas, a liquid fuel, an oxidant, and an inert.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
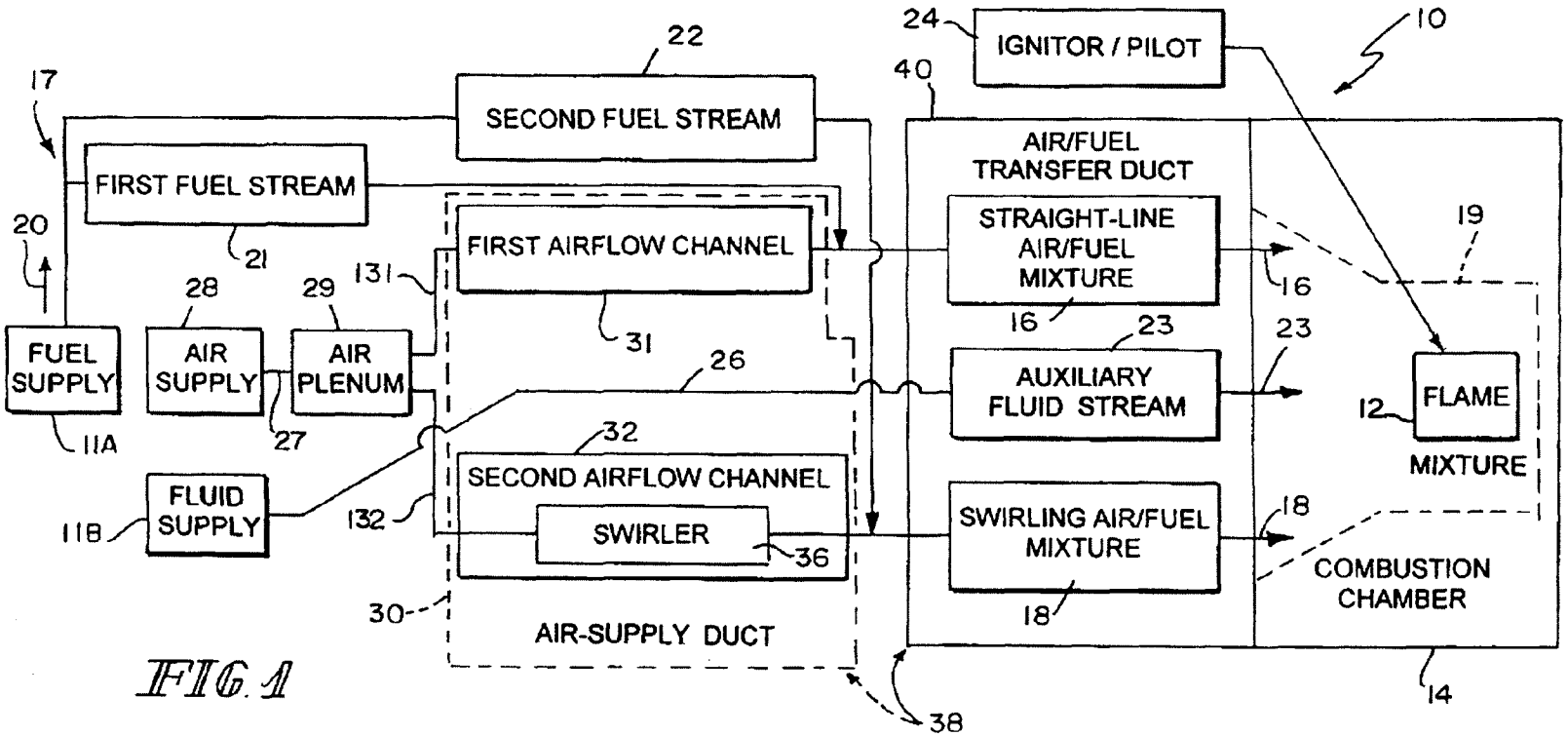
FIG. 1 is a diagrammatic view of a burner in accordance with the present disclosure showing discharge of (1) a first fuel stream into a stream of air flowing in a first airflow channel to produce a "straight-line" air/fuel mixture flowing through an air/fuel transfer channel into a combustion chamber; (2) a second fuel stream into a stream of "swirling" air flowing in a second airflow channel containing a swirler to produce a "swirling" air/fuel mixture flowing through the air/fuel transfer channel "alongside" the straight-line air/fuel mixture into the combustion chamber; and (3) an auxiliary fluid stream into the combustion chamber, and showing ignition of the straight-line and swirling air/fuel mixtures and the auxiliary fluid stream in the combustion chamber to produce a flame.
Figure 3:
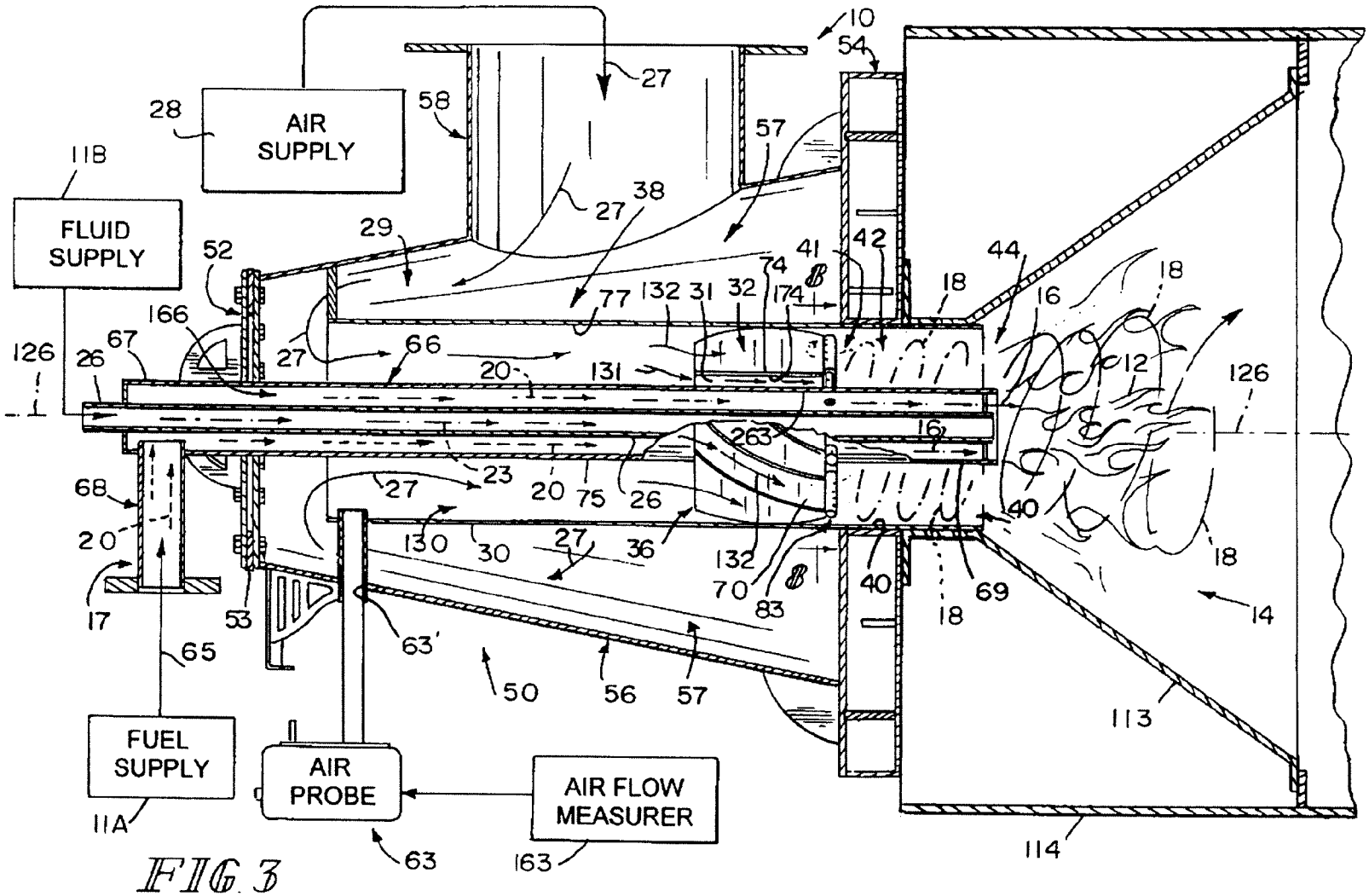
FIG. 3 is a sectional view of the burner taken along line 3-3 of FIG. 2 after assembly of the components shown in FIG. 1 showing placement of the air-swirl vanes and the vane-support sleeve in an annular space defined between the fuel-supply tube and a surrounding air-supply duct to "split" the air flowing through an air-supply duct toward a combustion chamber formed in a downstream burner cone and sleeve into (1) a "straight-line" air stream flowing in the annular inner (first) airflow channel formed between an exterior surface of the fuel-supply tube and an interior surface of the vane-support sleeve and mixing with fuel streams discharged through a first set of fuel jet ports located in the annular inner first airflow channel and (2) a "swirling" air stream flowing in an annular outer (second) airflow channel (containing a swirler defined by the air-swirl vanes) formed between an exterior surface of the vane-support sleeve and an interior surface of the air-supply duct and mixing with fuel streams discharged through a second set of fuel jet ports formed in the air-swirl vanes to establish a swirling air/fuel mixture surrounding the straight-line air/fuel mixture and cooperating with the straight-line air-fuel mixture (and with an auxiliary fluid stream passing through a small-diameter fluid-injector tube extending through the fuel-supply tube) to establish a combustible air/fuel mixture that flows through an air/fuel transfer channel arranged to extend from the air-swirl vanes to the combustion chamber and located between the exterior surface of the fuel-supply tube and the interior surface of the air-supply duct and ignites in the combustion chamber to produce a stable flame associated with a downstream end of the fuel-supply tube.

An air-fuel combustion system 10 for burning a mixture of air and fuel to produce a flame 12 in a combustion chamber 14 is shown diagrammatically in FIG. 1 and illustratively in FIG. 3. A "straight-line" air/fuel mixture 16 produced by mixing a first fuel stream 21 with a non-swirling laminar flow of air flowing in a first airflow channel 31 combines in combustion chamber 14 with a "swirling" air/fuel mixture 18 produced by mixing a second fuel stream 22 with swirling air flowing in a second airflow channel 32 as shown diagrammatically in FIG. 1 and illustratively in FIGS. 4-7. An auxiliary fluid stream 23 is also discharged into combustion chamber 14 through a fluid-injector tube 26 in an illustrative embodiment to mix with mixtures 16 and 18 to produce combustible mixture 19. Combustible mixture 19 is ignited by ignitor/pilot 24 to produce a stable flame 12 in combustion chamber 14 as shown diagrammatically in FIG. 1 and illustratively in FIG. 3.

Any suitable fuel can be provided by fuel supply 11A. Fluid supply 11B may be configured to supply various fluids including fuel gases, liquid fuels, inert gases, or oxidants to combustion chamber 14 via fluid-injection tube 26. Fuels may be supplied by fluid supply 11B as gases or liquids to create waste burning, combination fuel, or dual fuel embodiments. Inerts such as steam or flue gas may be supplied by fluid supply 11B to assist in the reduction of pollutant formations. Oxidants such as air or oxygen may be supplied by fluid supply 11B to boost burner capacity or increase flame temperatures. In an illustrative embodiment, fuel gas is provided by fuel supply 11A and oil is provided by fuel supply 11B. It is within the scope of this disclosure to use one fuel supply in lieu of two supplies 11A, 11B.

As suggested in FIG. 1, in an illustrative embodiment, combustion air 27 flows from air supply 28 through air plenum 29 into an air-supply duct 30 containing first and second airflow channels 31, 32. "Duct," as used herein, means a pipe, tube, or channel that conveys a substance. Fuel 20 discharged from a fuel supply 11A is split to produce (1) a first fuel stream 21 that mixes with combustion air 131 flowing through first airflow channel 31 and (2) a second fuel stream 22 that mixes with combustion air 132 flowing through second airflow channel 32 as suggested in FIG. 1.

A swirler 36 is associated with second airflow channel 32 and configured to provide means for swirling combustion air 132 flowing in second airflow channel 32 in a direction toward combustion chamber 14. In the illustrative embodiment, swirler 36 is arranged to swirl only combustion air and not fuel or an air/fuel mixture. Also, in an illustrative embodiment, swirler 36 includes a sleeve 74 arranged to define a boundary between first and second airflow channels 31, 32 as suggested in FIG. 3.

In an illustrative embodiment, air-supply duct 30 is formed to include an air-conductor passageway 130 containing swirler 36 as shown, for example, in FIGS. 1 and 3. An upstream end of air-supply duct 30 is arranged to communicate with air plenum 29 to allow combustion air 27 to flow from air plenum 29 into air-conducting passageway 130 so as to intercept swirler 36.

An air/fuel transfer channel 40 is interposed between air-supply duct 30 and combustion chamber 14 in an illustrative embodiment as shown diagrammatically in FIG. 1 and illustratively in FIG. 3. A fluid-injector tube 26 is coupled to fluid supply 11B and arranged to extend through air/fuel transfer channel 40 to conduct an auxiliary fluid stream 23 into combustion chamber 14 as shown diagrammatically in FIG. 1 and illustratively in FIG. 3. Air/fuel transfer channel 40 provides means for conducting straight-line air/fuel mixture 16 and swirling air/fuel mixture 18 to combustion chamber 14 where mixtures 16, 18 cooperate with auxiliary fluid stream 23 to define combustible mixture 19. In an illustrative embodiment, shown in FIGS. 5 and 6, straight-line air/fuel mixture 16 flows into combustion chamber 14 through a small-diameter inner annular zone 41 (defined by small dimension 141) located in air/fuel transfer channel 40 and swirling air/fuel mixture 18 flows into combustion chamber 14 through a large-diameter outer annular zone 42 (defined by larger dimension 142) surrounding small-diameter inner annular zone 41 and lying in air/fuel transfer channel 40.

Figure 5:
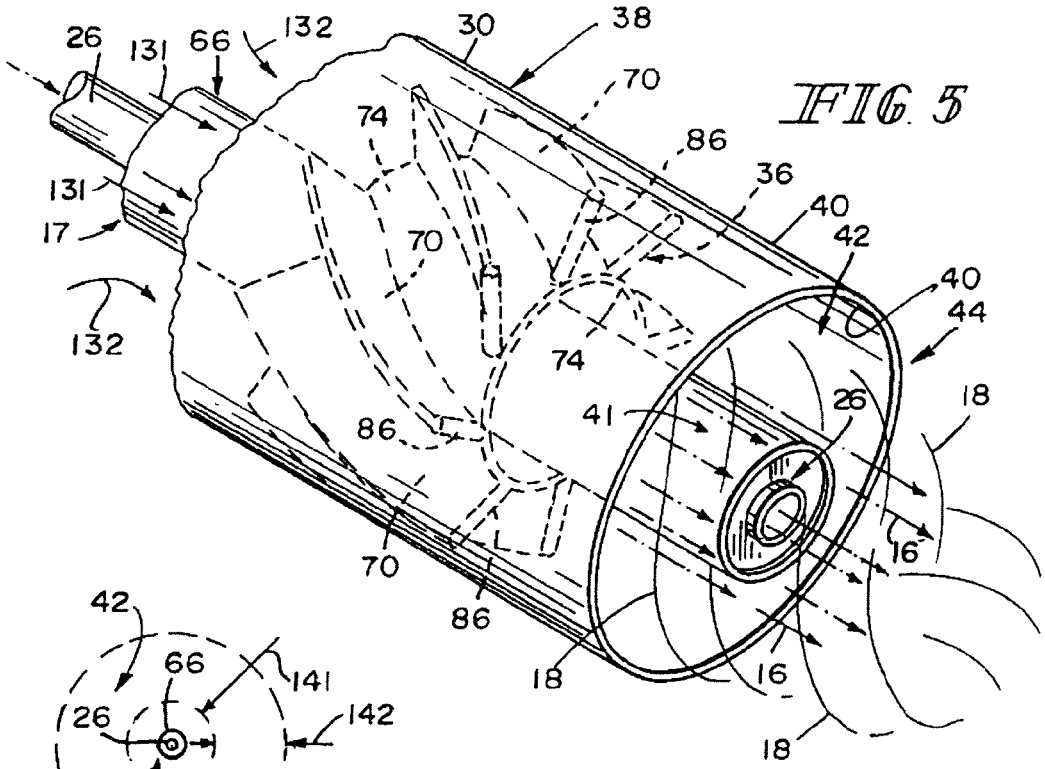
FIG. 5 is a perspective view of the air-supply duct of FIG. 4 taken from a different point of view showing the straight-line air/fuel mixture flowing along the cylindrical exterior surface of the fuel-supply tube and showing the swirling air/fuel mixture flowing in a spiraling pattern along the cylindrical interior surface of the air supply tube and around the straight-line air/fuel mixture and showing an auxiliary fluid stream being discharged from a small-diameter fluid-injector tube extending through a downstream end of the larger-diameter fuel-supply tube.
Figure 6:
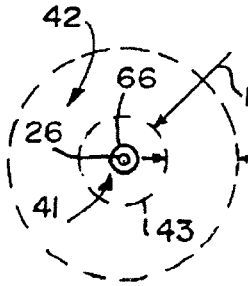
FIG. 6 is a diagrammatic view showing a center circle representing the fuel-supply tube and containing a smaller circle representing the fluid-injector tube, a "small-diameter" annular zone around the fuel-supply tube containing the straight-line air/fuel mixture, a "large-diameter" annular zone surrounding the small-diameter annular zone and containing the swirling air/fuel mixture, and a circular "shear" interface (shown in phantom) between the small-diameter and large-diameter annular zones.

A somewhat "cylindrical" shear layer stabilization boundary 43 is created between inner and outer annular zones 41, 42 in air/fuel transfer channel 40 and an inlet region 44 provided in combustion chamber 14 as suggested diagrammatically in FIG. 6 and illustratively in FIG. 5. Ignition of straight-line and swirling air/fuel mixtures 16, 18 and auxiliary fluid stream 23 in combustion chamber 14 using ignitor 24 produces a stable flame 12. Flame attachment of flame 12 is provided by reacting boundary layers along shear layer stabilization boundary 43 located between inner and outer annular zones 41, 42 to define a "zero-velocity" flow zone containing at least the root of flame 12. In other words, flame 12 is attached by reacting swirling air/fuel mixture 18 and annular straight-line air/fuel mixture 16 accelerated by fluid-injector tube 26 working in combination with the resultant zero velocity flow zone. Flame attachment is enhanced by the presence of an annular flow guide provided by fluid-injector tube 26. Fluid-injector tube 26 also enhances the stable operation range of burner 10 by providing low-flow recirculation eddies.

Figure 2:
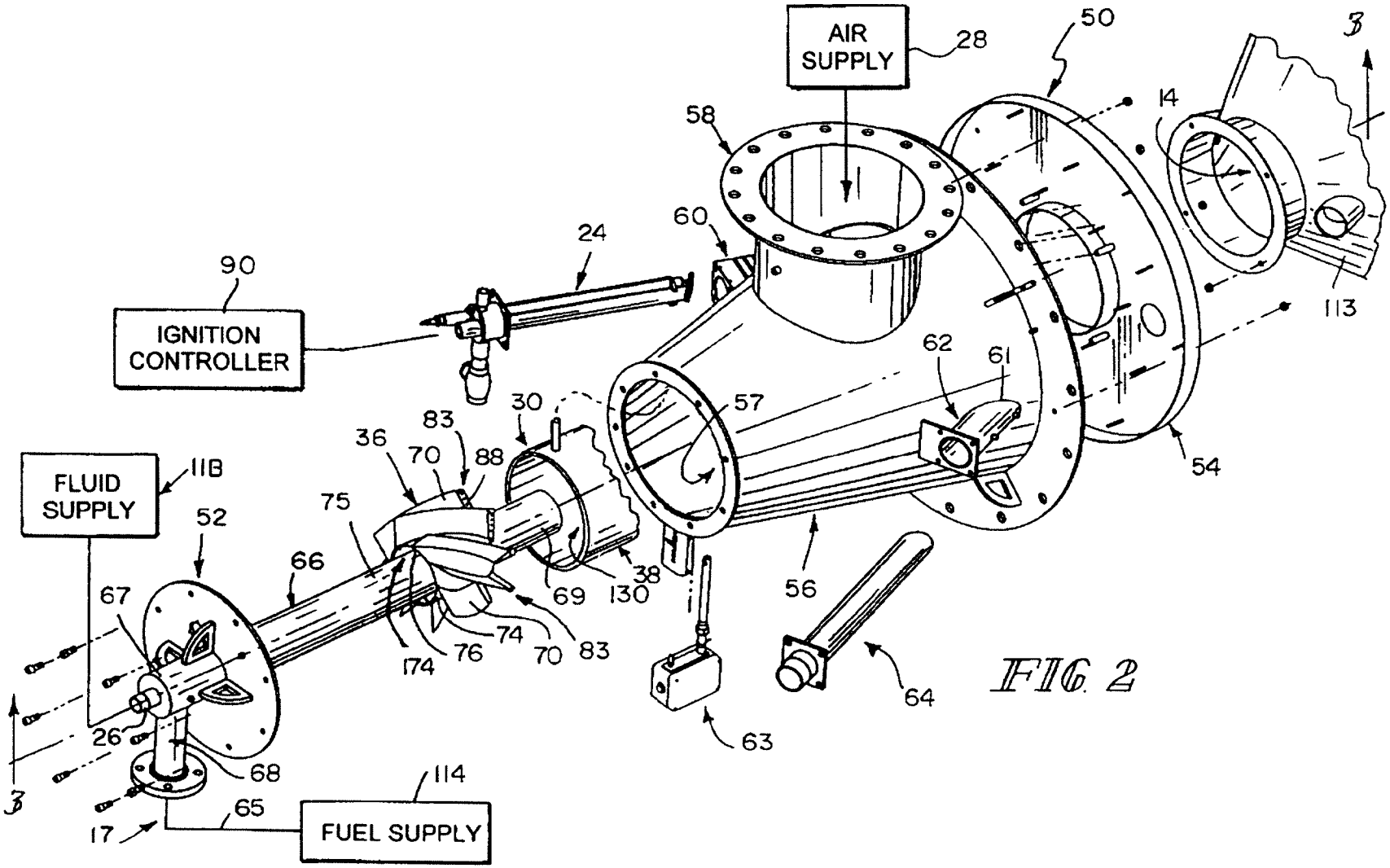
FIG. 2 is a perspective exploded assembly view of components included in a burner in accordance with the present disclosure showing several air-swirl vanes mounted in a "pinwheel" pattern on an exterior surface of a vane-support sleeve surrounding a fuel-supply tube coupled to a fuel supply to provide an annular opening into an inner (first) airflow channel formed between the fuel-supply tube and the vane-support sleeve and showing fuel jet ports formed in a downstream end of each air-swirl vane for emitting streams of fuel into swirling air swirled by the air-swirl vanes.

Air-fuel combustion system 10 includes an air-supply housing 50 comprising a small-diameter front plate 52, a large-diameter rear plate 54, and a frustoconical shell 56 arranged to extend between front and rear plates 52, 54 as suggested in FIGS. 2 and 3. A gasket 53 is interposed between front plate 52 and a circular flange provided on a small-diameter end of frustoconical shell 56 as suggested in FIGS. 3 and 7 to establish a sealed connection between front plate 52 and shell 56.

An elongated pipe 38 includes both air-supply duct 30 and air/fuel transfer channel 40 in an illustrative embodiment as shown in FIG. 3. Elongated pipe 38 is fixed to extend into an interior region 57 formed in frustoconical shell 56 so that at least air-supply duct 30 lies in that interior region 57 as shown in FIG. 3. Air-supply housing 50 also includes an air inlet pipe 58 having one end adapted to receive combustion air from air supply 28 and another end coupled to frustoconical shell 56 to discharge combustion air from air supply 28 through an aperture formed in frustoconical shell 56 into an air plenum 29 provided inside air-supply housing 50 as suggested in FIG. 3. In an illustrative embodiment, front plate 52, frustoconical shell 56, and elongated pipe 38 cooperate to define air plenum 29 as shown, for example, in FIG. 3. Elongated pipe 38 is arranged to cause a downstream end of air/fuel transfer channel 40 to open into combustion chamber 14 as shown, for example, in FIG. 3.

A pilot-mount fixture 60 is coupled to one side of frustoconical shell 56 to mate with a first aperture 59 formed in shell 56. A viewer-mount fixture 62 for combustion chamber viewer 64 is coupled to another side of shell 56 to mate with a second aperture 61 formed in shell 56. An air probe fixture 63 is coupled to shell 56 as shown, for example, in FIG. 3 to mate with a third aperture 63 formed in shell 56. An air flow measurer 163 is coupled to air probe fixture 63 and used to measure the flow rate of air 27 in air-supply duct 30.

A fuel-supply tube 66 is arranged to extend through a passageway formed in elongated pipe 38 and fluid-injector tube 26 is arranged to extend through a fuel-conductor passageway 166 formed in fuel-supply tube 66 along a "center line" path 126 through burner 10 as shown in FIG. 3. Fuel-supply tube 66 includes an outer end 67 coupled to an inlet tube 68 that is connected to fuel supply 11A by supply line 65 and an inner end 69 arranged to extend into an interior region of air-supply housing 50. Outer end 67 of fuel-supply tube 66 extends through an aperture formed in front plate 52 of air-supply housing 50 as shown, for example, in FIGS. 2 and 3. Supply line 65, fuel-supply tube 66, and inlet tube 68 cooperate to define a fuel-supply duct 17 configured to conduct fuel 20 from fuel supply 11A to first and second airflow channels 21, 22.

Figure 4:
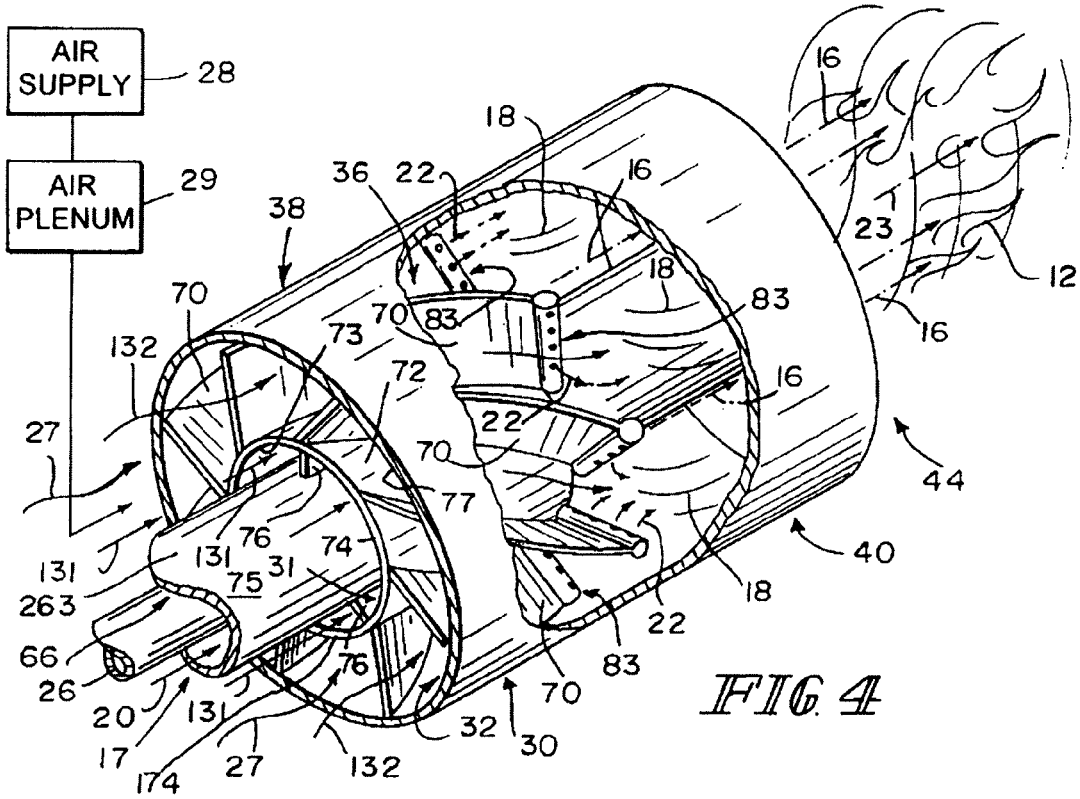
FIG. 4 is an enlarged perspective view of the air-supply duct of FIGS. 2 and 3, with portions broken away, showing air flowing from the air plenum through a small-diameter annular opening into the inner (first) airflow channel and through a surrounding large-diameter annular opening into the outer (second) airflow channel and showing discharge of a second stream of fuel through the second set of jet ports to mix with swirling air discharged from the annular outer (second) airflow channel to produce a swirling air/fuel mixture flowing in a spiraling pattern in the downstream air/fuel transfer channel.
Figure 8:
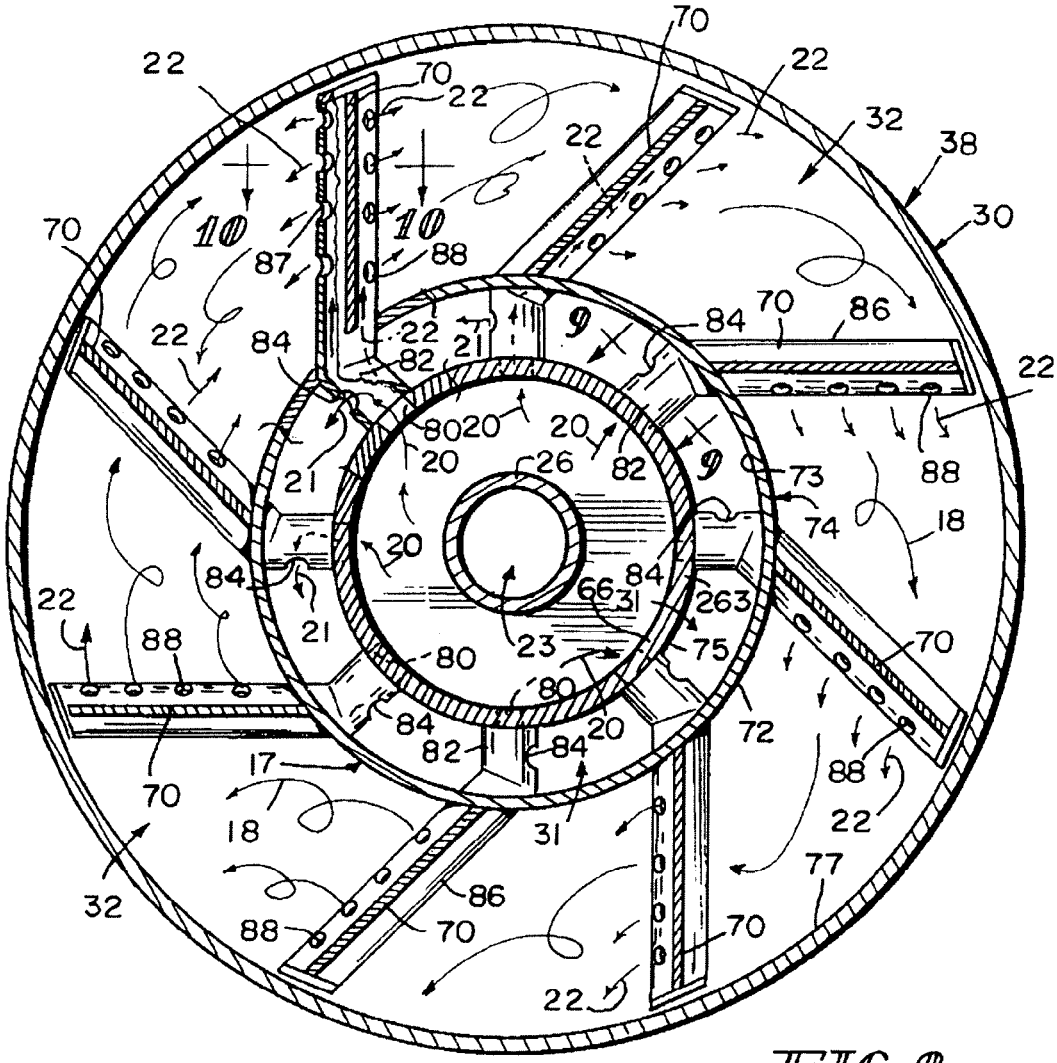
FIG. 8 is an enlarged sectional view taken along line 8-8 of FIG. 3 showing radially outward flow of fuel from the fuel-supply tube through apertures formed in the fuel-supply tube into short radiated first-stage fuel transfer tubes and then into the annular inner (first) airflow channel through fuel jet ports formed in the short radiated first-stage fuel transfer tubes to generate a straight-line air/fuel mixture flowing in the air/fuel transfer channel toward the combustion chamber and showing further radially outward flow of fuel from the short radiated first-stage fuel transfer tube into longer angled second-stage fuel transfer tubes formed in downstream ends of the air-swirl vanes and then into the annular outer (second) airflow channel through fuel jet ports formed in the angled second-stage fuel transfer tubes to generate a "swirling" air/fuel flowing mixture in the air/fuel transfer channel toward the combustion chamber.

As shown, for example, in FIGS. 2, 4, and 8, swirler 36 comprises several air-swirl vanes 70 mounted in a "pinwheel" pattern on an exterior surface 72 of an annular vane-support sleeve 74. In an illustrative embodiment, each air-swirl vane 70 has a helical shape as suggested in FIGS. 2-4.

In an illustrative embodiment, vane-support sleeve 74 is cylindrical and formed to include a duct-receiver passageway 174 extending therethrough and receiving a portion of fuel-supply tube 66 therein as suggested, for example, in FIGS. 2, 3, and 8. As suggested, for example, in FIGS. 3, 4, and 8, vane-support sleeve 74 is arranged to separate and define a boundary between first and second airflow channels 31, 32 locating first airflow channel 31 in a space between an exterior surface 75 of fuel-supply tube 66 and an interior surface 73 of vane-support sleeve 74 and locating second airflow channel 32 in a space between an exterior surface 72 of vane-support sleeve 74 and an interior surface 77 of air-supply duct 30.

Vane-support sleeve 74 is arranged to lie inside air-conductor passageway 130 formed in air-supply duct 30 of elongated pipe 38 and to receive and surround a mid-portion 263 of fuel-supply tube 66 as suggested in FIGS. 3 and 8. Radially extending standoffs 76 are arranged to extend between a cylindrical exterior surface 75 of fuel-supply tube 66 and a cylindrical interior surface 73 of vane-support sleeve 74 to define an elongated, annular, first airflow channel 31 therebetween as suggested in FIGS. 4 and 8. Cylindrical exterior surface 72 of vane-support sleeve 74 lies inside and in spaced-apart relation to a cylindrical interior surface 77 of air-supply duct 30 to define an elongated, annular, second airflow channel 32 therebetween as suggested in FIGS. 4 and 8.

As suggested in FIGS. 3 and 4, vane-support sleeve 74 is placed in an annular space between fuel-supply tube 66 and the surrounding air-supply duct 30 of elongated pipe 38 to "split" combustion air 27 flowing through air-supply duct 30 toward combustion chamber 14 formed in a downstream burner discharge cone 113 and sleeve 114. Combustion air 27 is split into (1) a "straight-line" air stream 131 (characterized, for example, by laminar flow) flowing in annular inner (first) airflow channel 31 and (2) a "swirling" air stream 132 flowing in annular outer (second) airflow channel 32.

A first fuel stream 21 is discharged into straight-line air stream 131 as suggested diagrammatically in FIG. 1 to produce straight-line air/fuel mixture 16. In an illustrative embodiment shown, for example, in FIGS. 8 and 9, fuel-supply tube 66 is formed to include a series of circumferentially and uniformly spaced-apart apertures 80. The fuel delivery system further includes a fuel sprayer 83 configured to provide means for discharging fuel 20 flowing in fuel-supply duct 17 and exiting from fuel-supply tube 66 through apertures 80 into each of first and second airflow channels 31, 32. In an illustrative embodiment, fuel sprayer 83 is located in a space provided between downstream ends of air-swirl vanes 70 and air/fuel transfer duct 40 and in air-conductor passageway 130 as suggested, for example, in FIGS. 3 and 4.

Figure 9:
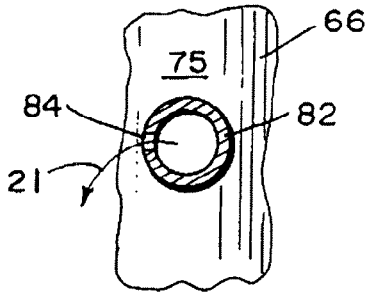
FIG. 9 is a sectional view taken along line 9-9 of FIG. 8 showing discharge of fuel through fuel jet ports formed in the short radiated first-stage fuel transfer tubes into the annular inner airflow channel.
Figure 11:
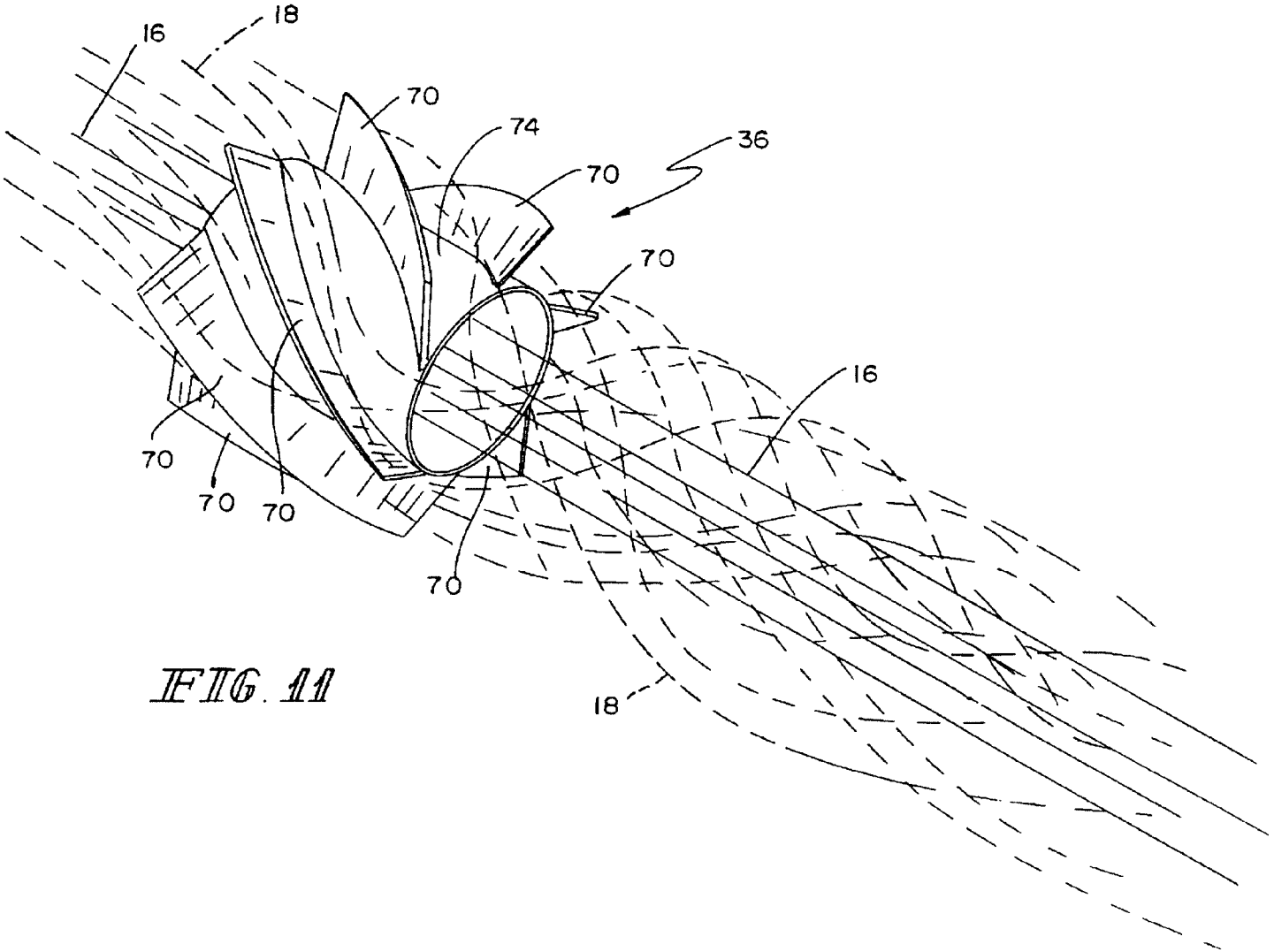
FIG. 11 is a perspective and diagrammatic view showing flow of the swirling air/fuel mixture in a spiraling pattern about the straight-line air/fuel mixture.

In an illustrative embodiment, fuel sprayer 83 includes a series of short radiated first-stage fuel transfer tubes 82 coupled to fuel-supply tube 66 as shown in FIGS. 8 and 9.

Each first-stage fuel transfer tube 82 is aligned with one of the apertures 80 to receive fuel discharged through that aperture 80 and is formed to include a side-discharge aperture 84 opening into first airflow channel 31. First fuel stream 21 flows through first-stage side-discharge apertures (i.e., a first set of fuel jet ports) 84 into first airflow channel 31 to mix with combustion air 131 flowing in first airflow channel 31 to produce straight-line air/fuel mixture 16. In an illustrative embodiment, first fuel stream 21 is about 10% of fuel 20 discharged from fuel supply 11A into fuel-supply tube 66.

Figure 10:
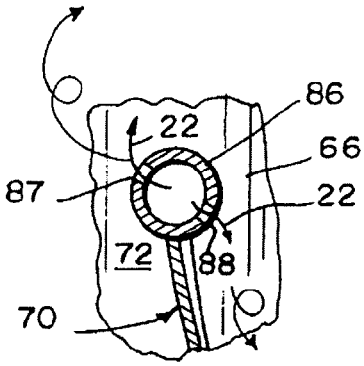
FIG. 10 is a sectional view taken along line 10-10 of FIG. 8 showing discharge of fuel through fuel jet ports formed in the longer angled second-stage fuel transfer tubes into the annular outer airflow channel.

A second fuel stream 22 is discharged by fuel sprayer 83 into swirling air stream 132 as suggested diagrammatically in FIG. 1 to produce swirling air/fuel mixture 18. In an illustrative embodiment shown, for example, in FIGS. 8 and 10, longer angled second-stage fuel transfer tubes 86 are included in fuel sprayer 83 and coupled to downstream ends of air-swirl vanes 70. Each second-stage fuel transfer tube 86 is coupled to an open-ended distal portion of one of the short radiated first-stage fuel transfer tubes 82 as suggested in FIG. 8 to receive any fuel discharged therefrom. Each second-stage fuel transfer tube 86 is formed to include a series of first and second side-discharge apertures (i.e., a second set of fuel jet ports) 87, 88 opening into second airflow channel 32. Second fuel stream 22 flows through first and second side-discharge apertures 87, 88 formed in second-stage fuel transfer tubes 86 to mix with combustion air 132 flowing in second airflow channel 32 to produce swirling air/fuel mixture 18. In an illustrative embodiment, the second fuel stream is about 90% full of fuel 20 discharged from fuel supply 11A into fuel-supply tube 66.

Figure 7:
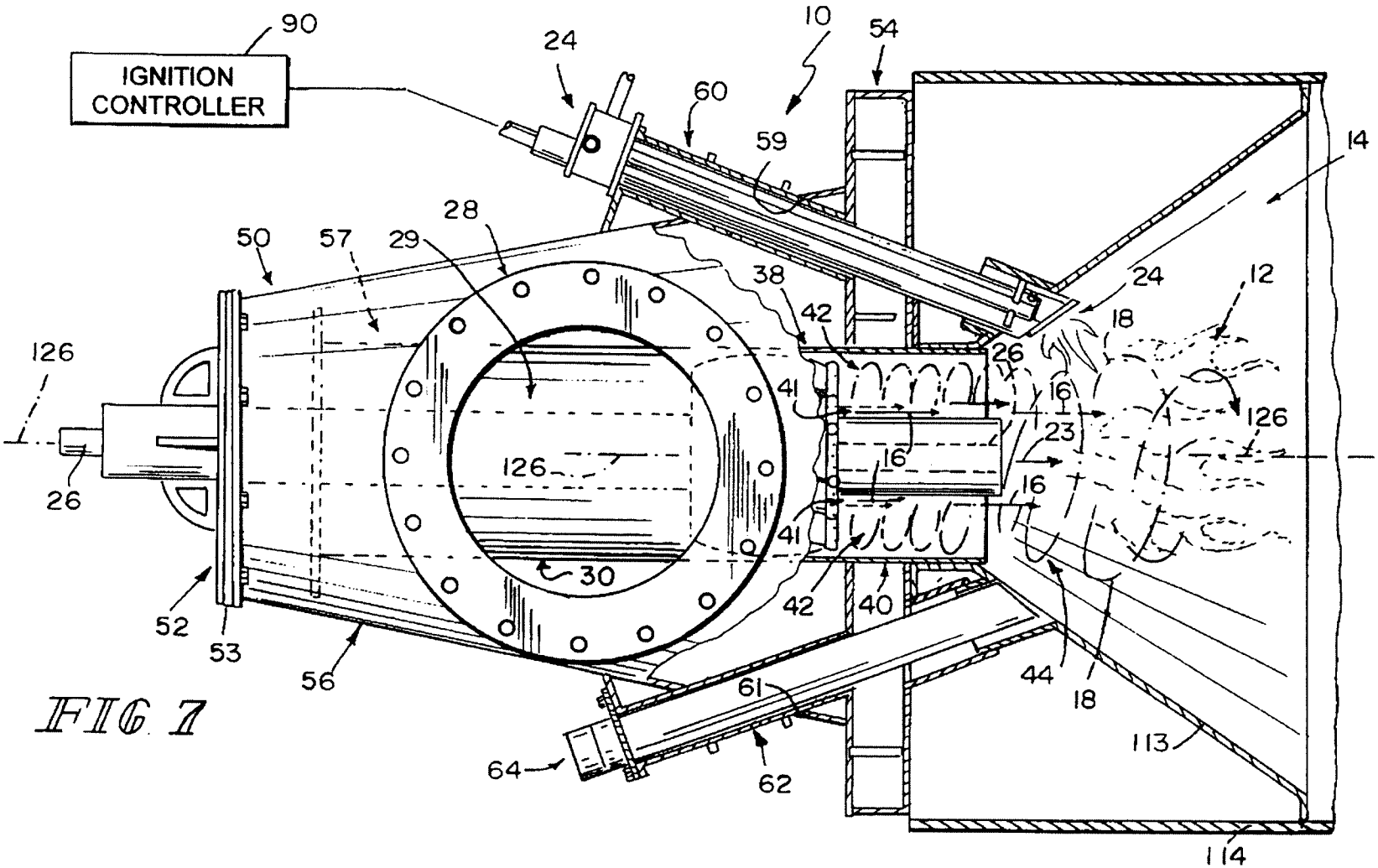
FIG. 7 is a top plan view of the burner shown in FIG. 3, with portions broken away, showing the auxiliary fluid stream flowing from the fluid-injector tube into the combustion chamber, along a "center-line" path through the burner, and showing an "interface" between the straight-line air/fuel mixture flowing through the air/fuel transfer channel into the combustion chamber and the swirling air/fuel mixture surrounding the straight-line air/fuel mixture and flowing in a spiraling pattern through the air/fuel transfer channel into the combustion chamber.

An ignition controller 90 is provided and coupled to ignitor/pilot 24 as shown, for example, in FIG. 7. Ignition controller 90 can be used to activate ignitor/pilot 24 and produce a spark or flame to ignite the combustible mixture 19 defined by straight-line air/fuel mixture 16, swirling air/fuel mixture 18, and auxiliary fluid stream 23 extant in combustion chamber 14. A stable flame 18 is produced and can be viewed and monitored using combustion chamber viewer 64 as suggested in FIG. 7.

The invention claimed is:

1. An air-fuel combustion system comprising an air/fuel transfer duct adapted to discharge an air-and-fuel mixture into a combustion chamber, an air-supply duct containing a first airflow channel in fluid communication with the air/fuel transfer duct, a separate second airflow channel in fluid communication with the air/fuel transfer duct, and a swirler located in the second airflow channel and configured to swirl combustion air flowing through the second airflow channel, and a fuel-supply duct coupled to discharge a first fuel stream generated from fuel flowing in the fuel-supply duct directly into combustion air flowing into the air/fuel transfer duct, wherein the air/fuel transfer duct is configured to provide means for conducting fuel, straight-line air discharged from the first airflow channel and the swirling air discharged from the second airflow channel to a combustion chamber for combustion therein, wherein substantially all mixing of the straight-line air, swirling air and fuel occurs after entering the air/fuel transfer duct.

2. The system of claim 1, further comprising injector means for mixing an auxiliary fluid stream with the straight-line air exiting the air/fuel transfer duct and with the swirling air exiting the air/fuel transfer duct to produce a combustible mixture ready to be ignited in the combustion chamber to produce a flame, wherein the auxiliary fluid stream comprises a fuel gas.

3. The system of claim 2, wherein the injector means includes a fluid-injector tube adapted at one end to be coupled to a fluid supply and at an opposite end to communicate with the combustion chamber and formed to include a fluid-conductor passageway means extending therethrough for conducting the auxiliary fluid stream from the fluid supply to the combustion chamber.

4. The system of claim 3, wherein the fluid-injector tube is arranged to extend through the air/fuel transfer duct, the air-supply duct, and the fuel-supply duct to reach the combustion chamber.

5. The system of claim 3, wherein the second airflow channel is arranged to surround the fluid-injector tube and the first airflow channel is arranged to surround the fluid-injector tube and lie in a space located between the fluid-injector tube and the second airflow channel.

6. The system of claim 3, wherein the fluid-injector tube is arranged to extend through the air/fuel transfer duct.

7. The system of claim 3, wherein the air-supply duct is formed to include an air-conductor passageway, the swirler is located in the air-conductor passageway, the fuel-supply duct includes a fuel-supply tube arranged to extend through the air-conductor passageway and formed to include a fuel-conductor passageway extending therethrough, the swirler includes an annular vane-support sleeve formed to include a duct-receiver passageway extending therethrough and receiving a portion of the fuel-supply tube therein and arranged to define a boundary between the first and second airflow channels locating the first airflow channel in a space between an exterior surface of the fuel-supply tube and an interior surface of the vane-support sleeve and the second airflow channel in a space between an exterior surface of the vane-support sleeve and an interior surface of the air-supply duct, and the swirler further includes air-swirl vanes mounted on the exterior surface of the vane-support sleeve, and wherein the fluid-injector tube is arranged to extend through the fuel-conductor passageway of the fuel-supply tube.

8. The system of claim 1, wherein the swirler includes a sleeve formed to include a duct-receiver passageway, a portion of the fuel-supply duct is arranged to extend through the duct-receiver passageway, and the sleeve is arranged to partition a space between an interior surface of the air-supply duct and an exterior surface of the portion of the fuel-supply duct to form the first and second airflow channels in said space.

9. The system of claim 8, wherein the sleeve of the swirler is arranged to define a boundary between the first and second airflow channels locating the first airflow channel in an inner space between the exterior surface of the portion of the fuel-supply duct and an interior surface of the sleeve and the second airflow channel in an outer space between an exterior surface of the sleeve and the interior surface of the air-supply duct.

10. The system of claim 9, wherein the swirler further includes several air-swirl vanes mounted on the exterior surface of the sleeve to lie in the second airflow channel and configured to impart swirling motion to combustion air flowing in the second airflow channel.

11. The system of claim 8, wherein the swirler further includes several air-swirl vanes coupled to the sleeve, arranged to lie in the second air-flow channel, and configured to impart swirling motion to combustion air flowing in the second airflow channel.

12. The system of claim 11, wherein each air-swirl vane has a helical shape and the air-swirl vanes are mounted in a pinwheel pattern on the sleeve.

13. The system of claim 11, wherein the fuel-supply duct includes a fuel sprayer located between the air-swirl vanes and air/fuel transfer duct and configured to provide means for discharging fuel flowing in fuel-supply duct into each of the first and second airflow channels so that a first fuel stream mixes with combustion air flowing in the first airflow channel to produce the straight-line air/fuel mixture and a second fuel stream mixes with combustion air flowing in the second air flow channel to produce the swirling air/fuel mixture.

14. An air-fuel combustion system comprising an air/fuel transfer duct adapted to discharge an air-and-fuel mixture into a combustion chamber, first-stage means for providing a laminar flow of air passing through a first airflow channel to produce non-swirling straight-line air entering the air/fuel transfer duct, and second-stage means for mixing a fuel stream provided by a fuel supply with a swirling flow of air passing through a second airflow channel to produce swirling air surrounding the non-swirling straight-line air and entering the air/fuel transfer duct, wherein substantially all mixing of the straight-line air, swirling air and fuel occurs after entering the air/fuel transfer duct.

15. The system of claim 14, further comprising a fluid-injector tube adapted to be coupled to a fluid supply and arranged to inject an auxiliary fluid stream into the straight-line and swirling air to produce a combustible mixture.

16. A process for generating an air-and-fuel mixture, the process comprising the steps of providing a stream of air flowing in a first airflow channel to produce a non-swirling straight-line airflow, providing a stream of swirling combustion air flowing in a second airflow channel separate from the first airflow channel to produce a swirling airflow, providing fuel directly to an air/fuel transfer channel, flowing the swirling air alongside the non-swirling straight-line air into the air/fuel transfer channel in a direction toward a combustion chamber to generate an air-and-fuel mixture flowing in the air/fuel transfer channel, and substantially mixing of swirling air, straight line air and fuel only after entering the air/fuel transfer duct.

17. The process of claim 16, further comprising the step of passing an auxiliary fluid stream comprising at least one of a fuel gas, a liquid fuel, an oxidant, and an inert gas through a fluid-injector tube extending through the first airflow channel to combine the auxiliary fluid stream with the air-and-fuel mixture to produce a combustible mixture.

18. The process of claim 16, further comprising the step of constraining the swirling air to flow along a path surrounding the non-swirling straight-line air flowing in the air/fuel transfer channel.

19. The process of claim 18, further comprising the step of flowing an auxiliary fluid stream comprising at least one of a fuel gas, a liquid fuel, an oxidant, and an inert gas through a space surrounded by the non-swirling straight-line air to produce a combustible mixture.

* * * * *